United States Patent [19]

Powers

[11] 4,129,139

[45] Dec. 12, 1978

[54] BABY GAZEBO

[76] Inventor: Betsy K. Powers, 20 South Water St., Lewisburg, Pa. 17837

[21] Appl. No.: 820,241

[22] Filed: Jul. 29, 1977

[51] Int. Cl.[2] ..... E04B 1/12

[52] U.S. Cl. ..... 135/3 E; 135/8; 135/15 PQ

[58] Field of Search ..... 52/63; 135/1 R, 3 R, 135/3 E, 8, 14 V, 15 CF, 15 PQ, DIG. 8, DIG. 9

[56] References Cited

U.S. PATENT DOCUMENTS

| | | | |
|---|---|---|---|
| 462,077 | 10/1891 | Gross | 135/3 R |
| 1,833,095 | 11/1931 | Smith | 135/14 V |
| 2,134,879 | 11/1938 | Levy | 135/3 E |
| 2,953,145 | 9/1960 | Moss | 135/1 R |
| 3,794,054 | 2/1974 | Watts | 135/14 V |
| 3,896,830 | 7/1975 | Sharick | 52/63 |
| 3,927,496 | 12/1975 | Kersavage | 52/80 |
| 3,990,463 | 11/1976 | Norman | 135/1 R |

*Primary Examiner*—Ernest R. Purser
*Assistant Examiner*—Henry Raduazo
*Attorney, Agent, or Firm*—Stevens, Davis, Miller & Mosher

[57] ABSTRACT

A portable, easily assembled outdoor shelter particularly suitable for infants is provided with connected side, roof and floor fabric surfaces which are supported in a raised position by aluminum poles passing through sleeves affixed to the exterior of the connected fabric surfaces between adjoining sides and by wires attached one each to a pair of poles diametrically opposed about the center axis of the shelter, the wires passing through a ring affixed to the center of the roof. The shelter is hexagonally shaped with three of its six sides having a larger upper portion of its surface area made of a fiberglass net material and a smaller lower portion made of a solid lightweight nylon fabric; the remaining three sides also being made of a solid lightweight nylon fabric. The roof is partially of fiberglass net material which can be covered by a removable sun shade.

12 Claims, 13 Drawing Figures

FIG. 3
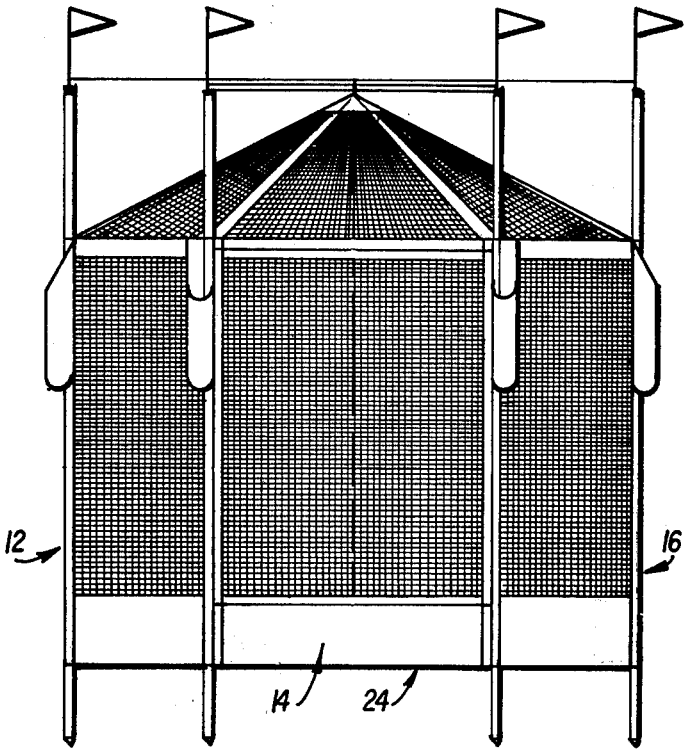
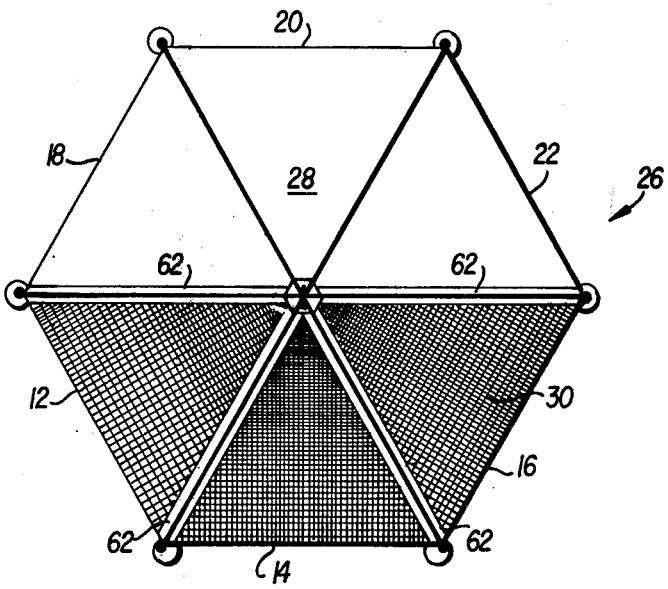
FIG. 4

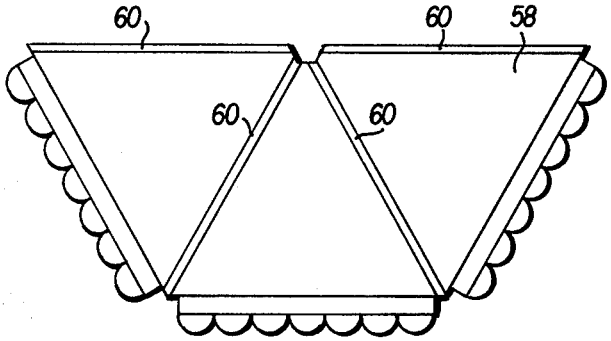
FIG. 8
FIG. 9A
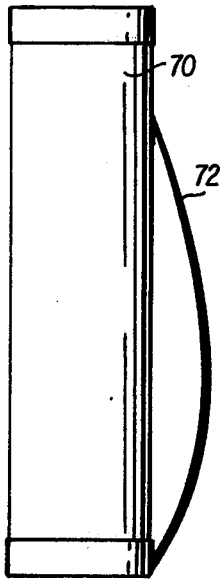
FIG. 9B
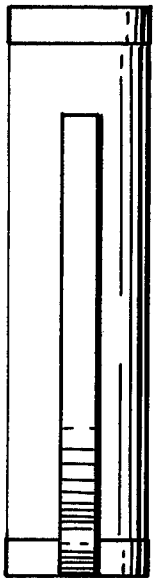
FIG. 9C
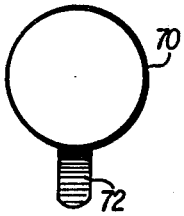
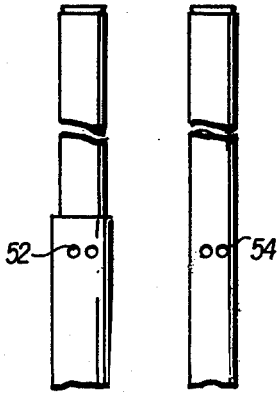
FIG. 10

BABY GAZEBO

BACKGROUND OF THE INVENTION

The present invention generally relates to portable self-supporting outdoor shelters and more specifically to an outdoor shelter which is particularly adapted to protect an infant from the sun, wind, sand and insects.

It is well known to provide portable tents or screened houses for camping or other recreational purposes. These devices are usually complex mechanisms involving several parts which must be fully assembled when desired. They often incorporate several moving parts which are capable of corroding when exposed to the elements, particularly salt air at a beach, and are often made entirely of a solid material which inhibits the flow of air and sun into the defined interior space. In addition, larger shelters usually have complex supporting structures which are heavy and thus not easily transported. In addition to the above, few shelters are designed for the particular requirements of an infant.

SUMMARY OF THE INVENTION

The present invention addresses the requirements of infants and has as one of its objects the provision of a suitable outdoor shelter or gazebo which can safely accommodate an infant and protect it from sun, wind, sand and insects and which can be used for camping, at the beach, etc.

Another object of the present invention is the provision of an infant shelter which is inexpensive, lightweight, easily assembled and which can be transported in a relatively small shoulder bag. Thus, both the shelter and an infant can easily be handled by a single person.

A further object of the invention is the provision of an infant shelter in which the amount of sun and/or wind entering the interior space can be adjusted.

All of the above objects are attained in a shelter which is preferably hexagonal in shape, containing six sleeves sewn into seams located at the joint formed by adjacent side panels. All side panels are sewn together and the roof and floor of the shelter are sewn respectively to the top and bottom of the side panels, thereby forming a one-piece shelter skin. All materials used to form the shelter skin are lightweight, fire-retardant, and inexpensive. Aluminum poles pass through the sleeves and are secured into the ground or sand to support the shelter in an upright position and relatively stiff wires attached to the top ends of aluminum poles diametrically opposed about the center axis of the shelter support the roof by passing through a ring attached to its center. A substantial portion of three of the six side panels of the shelter are formed from a netting fabric, such as a fiberglass screening, while the remaining three side panels are formed by a solid lightweight fabric. The roof contains two portions, one being of netting fabric and the other being of solid lightweight fabric.

The amount of sun and/or wind flowing into the interior of the shelter can be controlled by a removable shade of solid lightweight fabric which can be attached over the roof netting material by well-known Velcro (Registered Trademark) strips.

Other objects of this invention will appear in the following detailed description and appended claims, reference being had to the accompanying drawings forming a part of the disclosure wherein like reference characters designate corresponding parts in several views.

BRIEF DESCRIPTION OF THE DRAWINGS

FIG. 3 is a front elevational view of the shelter showing the sun shade removed.

FIG. 4 is a top plan view of the shelter illustrated in FIG. 3.

FIG. 8 is an underside view of the removable sun shade.

FIGS. 9A, 9B and 9C illustrate two side views and an end view of a suitable bag for carrying the shelter.

FIG. 10 illustrates eyelets for facilitating the attachment of supporting guide ropes to the shelter supporting structure.

DESCRIPTION OF THE PREFERRED EMBODIMENTS

Figure 1:
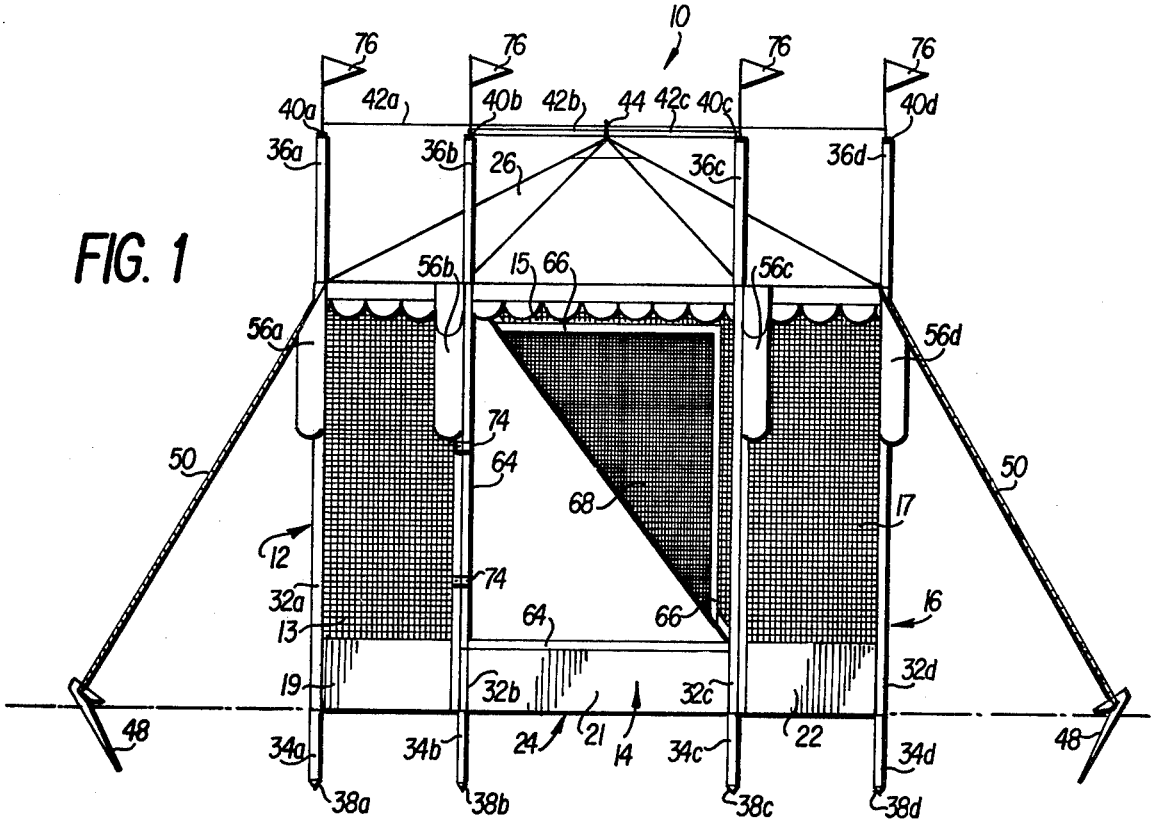
FIG. 1 is a front elevational view of the infant shelter of the present invention with the removable sun shade in place.
Figure 2:
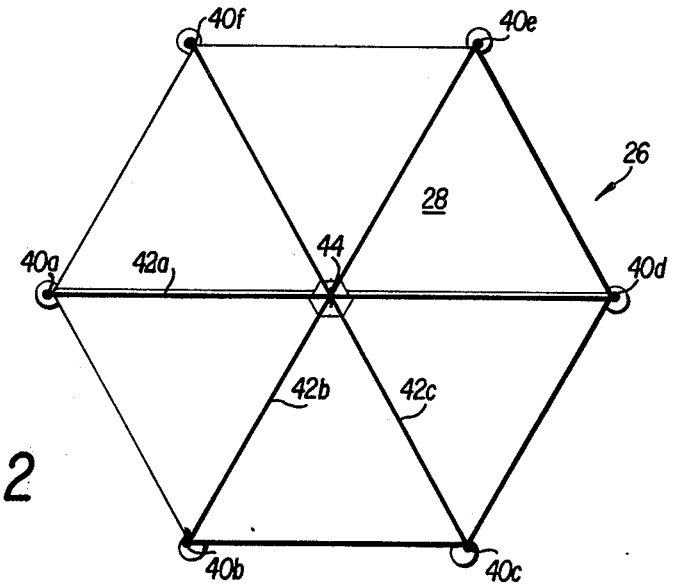
FIG. 2 is a top plan view of the shelter illustrated in FIG. 1.
Figure 5:
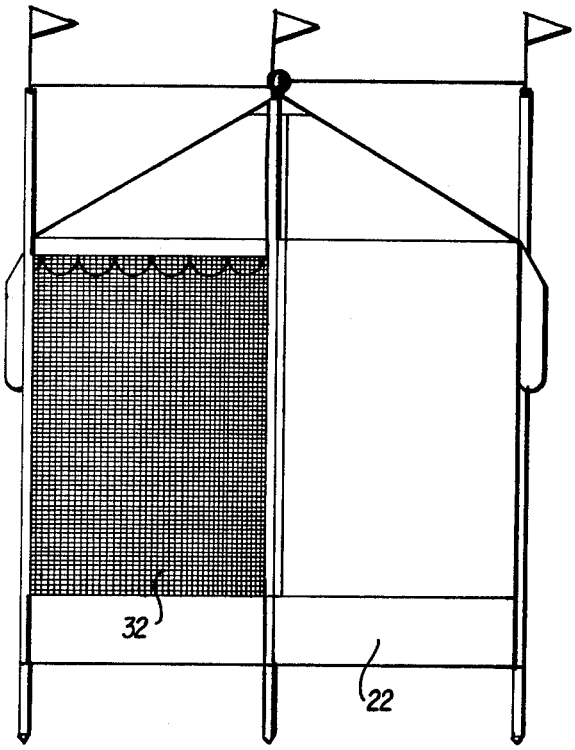
FIG. 5 is a side view of the shelter illustrated in FIG. 1.

Referring to the drawings, the invention will now be described in greater detail. The infant shelter 10 preferably includes a one-piece hexagonally shaped fabric assembly formed from panel sections which are sewn together. A hexagonal shaped shelter is desirable because it will present less of a flat surface to the wind than a four sided structure while providing the same square footage inside, thereby making the shelter more stable. Additionally, a six-sided structure uses more supporting posts and anchoring mechanisms, thereby further increasing stability and providing greater ventilation of the interior. The one-piece assembly includes three sides 12, 14, 16 each having a portion made from a netting material, such as a fiberglass screen and a portion 19, 21, 23 made from a solid lightweight flexible nylon windbreaker fabric which is impervious to sand and wind, three sides 18, 20, 22 and a floor 24 made from the flexible nylon windbreaker fabric, and a roof (FIG. 4) having one-half of its area 28 constructed of the nylon windbreaker fabric and the other half 30 constructed of the netting material. The one-piece fabric assembly further includes six sleeves, four of which **32*a* ... 32*d* are shown in FIG. 1 (the other two are on the back side of the shelter) extending substantially the entire height of the sides of the shelter. These sleeves are sewn along the points of the hexagon at the joint formed by two adjacent sides of the shelter, e.g., sleeve 32*c* is sewn at the point formed by sides 14 and 16**. Each sleeve is so constructed as to have a continuous smooth interior surface.

The supporting structure for the one-piece fabric assembly includes six aluminum poles **34*a* ... 34*f*, four of which 34*a* ... 34*d* are shown in FIG. 1. The aluminum poles which are of tubular design and circular cross-sectional area contain openings 36*a* ... 36*f* at one end and pointed exterior surfaces 38*a* ... 38*f* on the other. Each aluminum pole has an exterior diameter which allows it to be snugly inserted through a sleeve of the one-piece fabric assembly until the bottom tip of the pole extends approximately six inches from the end of the sleeve. The length of the poles is such that when the poles extend six inches from the end of the sleeve on one end they further extend approximately one foot from the other end of a sleeve. The open end of each aluminum pole receives a rubber stopper 40***a* ... 40*f*. Diametrically opposed poles have their rubber stoppers interconnected by stiff wires 42*a* ... 42*c* which pass through aluminum ring 44 attached to the center of the shelter roof 26. The ends of the wires pass through centrically located holes in associated rubber stoppers 40*a* ... 40*f* and have rounded end portions 46*a* ... 46*c* which prevent the wires from slipping through the rubber stoppers and further prevent injury to the infant should the wires slip out of the rubber stoppers. The length of the wires 42*a* ... 42*c* is dimensioned to effect a roof pull-up condition when the rubber stoppers are inserted into respective aluminum support poles. The wires are of sufficient stiffness or compressive strength to keep the upper portions of paired poles to which they are attached from moving inward towards one another. It is apparent that the wires serve, in conjunction with ring 44, as the support for the roof of the shelter.

Figure 6A:
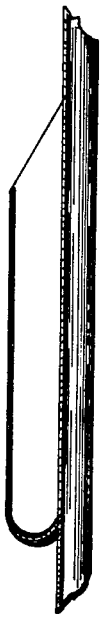
FIGS. 6A and 6B are close up views of the pockets of the shelter.
Figure 6B:
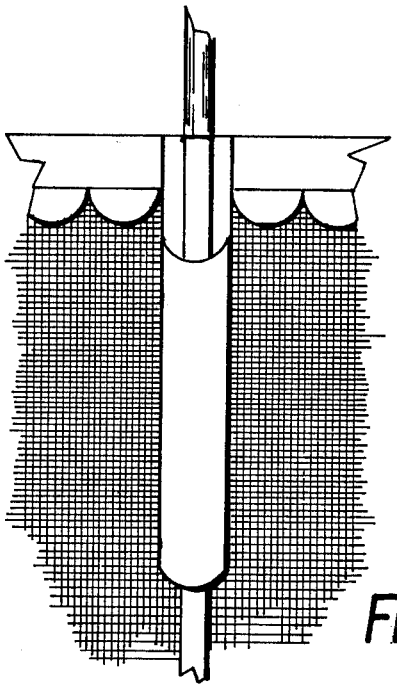
Figure 7:
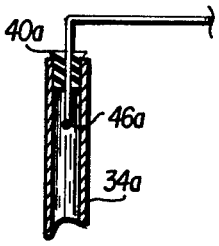
FIG. 7 is a view of the top of one of the supporting poles housing a rubber plug and roof support wire.

Although aluminum poles 34*a* ... 34*f* alone are usually suitable for supporting the shelter, additional support may be provided by stakes 48 and associated nylon cords 50. Nylon cords 50 attach to the aluminum poles near the point where they exit from the sleeve at the top of the shelter sides. To facilitate this attachment, eyelets 52 and 54 are provided, respectively, in the sleeves and aluminum poles. Eyelets 52 also contain grommets. The ends of nylon cords 50 are suitably tapered and hardened in order to facilitate their insertion through the eyelets. Nylon cords 50 are also attached to stakes 48 which may be used to place the cords in tension, thereby pulling on the aluminum poles and adding further support to the shelter. Pockets 56*a* ... 56*f* are attached one each to a sleeve at the top of the shelter sides for housing stakes 48 and associated nylon cords 50 when not in use. FIGS. 6A and 6B show in enlarged detail the attachment of the pockets to the sleeves.

FIG. 8 shows the underside of the removable sun shade 58. Sun shade 58 is cut to fit over the netting portion 30 of roof 26 and is attached thereto by a suitable fastening device. A preferred fastening device is Velcro strips which have complimentary surfaces of material which when pushed together form a fastening device. FIGS. 4 and 8 illustrate the attachment of the complimentary surfaces of the Velcro strips to, respectively, the shelter roof and the sun shade. In FIG. 8 strips 60 are sewn to the underside of the sun shade at positions corresponding to positions on netting portion 30 of roof 26 where complimentary surface strips 62 are secured. When sun shade 58 is to be attached to roof portion 30, it is merely placed in position and hand pressure is applied over the length of the complimentary strips 60, 62 securing them together. Of course, a well-known characteristic of Velcro strips is that the complimentary surfaces can easily be separated by pulling them apart when desired.

Velcro strips are also used as preferred fasteners for a door for the shelter and complimentary surface strips 64, 66 are accordingly provided on the sides and bottom of a door frame and door flap 68. A more secure fastening device may also be attached to the door in addition to the Velcro strips; for example, suitable locking devices 74 may be employed.

The one-piece fabric assembly, aluminum poles, 32*a* ... 32*f*, stakes 48, nylon cords 50, and sun shade 58 are all housed in a lightweight carrying case, illustrated in FIGS. 9A, 9B and 9C. The case 70 may be constructed of the same nylon windbreaker material as the shelter, but may contain reinforcing on the bottom to prevent the aluminum posts from breaking through. A reinforced nylon windbreaker material carrying strap 72 is also provided.

The materials used for the shelter and the case are washable; both the netting and the nylon windbreaker material are also preferably fire retardant in order to reduce the risk of injury to an infant. The aluminum poles, although pointed at one end, have rounded or cone shaped projections to further reduce the possibility of infant injury during transportion or assembly of the shelter. The fabric panels 19, 21 and 23 which are approximately 6 inches high, provided on the screened sides of the shelter, inhibit the entry of sand or dirt into the interior of the shelter to further protect an infant. Flat feld seam stitching is used throughout to construct the one-piece fabric assembly, which results in smooth interior surfaces in both the sleeves 32*a* ... 32*f* and the interior of the shelter. Decorative flags may be optionally attached to the aluminum poles as by tying in order to further provide an attractive appearance to the erected shelter.

The assembly of the infant shelter will now be described.

Aluminum poles 34*a* ... 34*f* are initially inserted into corresponding sleeves 32*a* ... 32*f* of the one-piece fabric assembly at home prior to actual assembly of the shelter at a desired location. Thus, when actual assembly of the shelter is desired, one need only remove the one-piece fabric assembly containing the aluminum poles from the carrying bag, pull the aluminum poles and attached sides of the shelter outward from the center axis of the shelter, push the poles into the ground in a configuration corresponding to the shape of the completed tent, and attach the rubber plugs 40*a* ... 40*f* containing relatively stiff wires 42*a* ... 42*c* to the top of diametrically opposed aluminum poles, after passing the wires through support ring 44. If additional shelter support is needed, nylon guy cords 50 and stakes 48 are removed from the pockets 56*a* ... 56*f*, and the cords, which are already attached to the aluminum poles through the eyelets, are secured to the ground with the stakes. The entire assembly operation may be carried out by a single person in less than five minutes, without the need for particular skill or extensive training. Exterior dimensions for a completely erected shelter include a peak height of four feet, a side-to-side width of three and one-half feet, a side height of three feet, and a side width of two feet.

In view of the foregoing description, it will be apparent that a relatively simple, lightweight, small-packaged, infant-safe screen house or gazebo has been provided which can be quickly assembled to provide an attractive outdoor shelter. However, it is to be understood that the above described embodiment of the invention is merely illustrative and that various modifications and alterations may be made to it without departing from the spirit and scope of the invention.

What is claimed is:

1. A portable shelter comprising:

a one-piece fabric assembly forming the roof, floor and sides of said shelter, said one-piece fabric assembly containing a plurality of sleeves running substantially the entire height of the sides of said shelter and located one each at the juncture of two sides of said shelter, at least one of the sides of said shelter having a larger upper portion of its surface area made of flexible netting fabric and a smaller bottom portion made of a solid lightweight flexible fabric, the remaining sides and floor of said shelter being made of said solid lightweight flexible fabric, said roof of said shelter having a first portion thereof made of said flexible netting fabric and a second portion thereof made of said solid lightweight flexible fabric, a ring attached to said roof, a plurality of poles each passing through a respective sleeve and having upper and lower ends extending outward of said sleeve, said upper end of each pole forming a tubular opening and said lower end of each pole terminating in a point which is adapted to be secured in the ground, a plurality of relatively stiff wires, a plurality of tapered resilient plugs associated one each with the ends of said wires, each end of each of said wires passing through an associated plug and having means for preventing the disengagement of said end from said associated plug, said plurality of plugs being respectively mounted in the tubular openings of said poles such that each of said wires passes through said ring and is attached to the upper end of two of said poles which are diametrically opposed about the center axis of said shelter, said wires serving to support the roof of said shelter.

2. A portable shelter as in claim 1 wherein each end of said wires has an enlarged surface area for preventing its withdrawal from an associated plug.

3. A portable shelter as in claim 1, further comprising:

a removable sun shade made of said solid lightweight flexible fabric detachably secured to said shelter over said first portion of said roof.

4. A portable shelter as in claim 3, wherein said shelter has a hexagonal shape and three of the sides of said shelter have a larger upper portion of their surface area made of said flexible netting fabric and a smaller bottom portion made of said solid lightweight flexible fabric, and the other three sides of said shelter are made entirely of said solid lightweight flexible fabric, and wherein said first and second portions of said roof are substantially equal in size.

5. A portable shelter as in claim 4 wherein one of the three shelter sides partially made of said netting fabric contains a door which is secured shut by Velcro strips attached to the sides and bottom of said door, and wherein said removable sun shade is attached to said roof by Velcro strips.

6. A portable shelter as in claim 5 further comprising a plurality of pockets made of said solid lightweight flexible fabric attached one each to an upper portion of a respective sleeve.

7. A portable shelter as in claim 5 further comprising a plurality of guy tension members secured one each on one end to a respective aluminum pole and on the other end to a respective stake in the ground for providing further structural support to said shelter.

8. A portable shelter as in claim 7 wherein said tubular aluminum poles and respective sleeves contain eyelets therein, said guy tension members containing tapered ends and being secured to said aluminum poles by having one said tapered end pass through said eyelets.

9. A portable shelter as in claim 5 wherein said flexible netting fabric is fire retardant and said solid lightweight flexible fabric is fire retardant and wind resistant.

10. A portable shelter as in claim 1 wherein said flexible netting fabric is made of fiberglass and said solid lightweight flexible fabric is made of nylon.

11. A portable shelter as in claim 5 further comprising a lightweight portable bag for carrying said shelter in a disassembled condition.

12. A portable shelter comprising:

a one-piece fabric assembly forming the roof, floor and sides of said shelter, said one-piece fabric assembly containing a plurality of sleeves running substantially the entire height of the sides of said shelter and located one each at the juncture of two sides of said shelter, said roof of said shelter having a first portion thereof made of said flexible netting fabric and a second portion thereof made of said solid lightweight flexible fabric, said shelter having a hexagonal shape with three sides having a larger upper portion of their surface areas made of said flexible netting fabric and a smaller bottom portion made of said solid lightweight flexible fabric, the other three sides being made entirely of said solid lightweight flexible fabric, said first and second portions of said roof being substantially equal in size, a removable sun shade made of said solid lightweight flexible fabric detachably secured to said shelter by Velcro strips over said first portion of said roof, a door provided in one of the three shelter sides partially made of said netting fabric which is secured shut by Velcro strips attached to the sides and bottom of said door, a plurality of tubular aluminum poles passing one each through said plurality of sleeves and having a lower portion and upper portion thereof extending outward from either end of an associated sleeve, said lower portion of each pole having a pointed end and adapted to be secured in the ground, said upper portion of each pole having a tubular open end, a plurality of relatively stiff wire roof support members having enlarged surface areas on their ends, and a plurality of tapered rubber plugs for attaching the two ends of each of said relatively stiff wires to the open end upper portion of two of said poles which are diametrically opposed about the center axis of said shelter, each of said roof support members passing through a ring attached to the roof of said shelter and serving to support said roof, said enlarged surface areas preventing said wires from disengaging from said associated tapered rubber plugs.

* * * * *